United States Patent [19]

Steinmann

[11] Patent Number: 4,855,974

[45] Date of Patent: Aug. 8, 1989

[54] MULTIPLE CONFIGURATION ADJUSTABLE WATCH AND BAND

[75] Inventor: Hardy Steinmann, New York, N.Y.

[73] Assignee: Watchout Fashions, Inc., New York, N.Y.

[21] Appl. No.: 155,237

[22] Filed: Feb. 12, 1988

[51] Int. Cl.[4] ..... G04B 37/00

[52] U.S. Cl. ..... 368/282; 224/175

[58] Field of Search ..... 368/280–282; 224/152, 164–180, 908–910

[56] References Cited

U.S. PATENT DOCUMENTS 1,626,160 4/1927 Schwalberg ..... 224/164

2,420,435 5/1947 Lackow ..... 224/164

FOREIGN PATENT DOCUMENTS 597560 5/1934 Fed. Rep. of Germany ..... 224/908

*Primary Examiner*—Bernard Roskoski

*Attorney, Agent, or Firm*—Handal & Morofsky

[57] ABSTRACT

The invention relates to a device and method for configuring a watchband (10) such that it can be worn in a non-conventional fashion on the user's upper arm or conventionally on the user's wrist. The invention is comprised of a shorter elastic strap (16) attached to a watch (12), this shorter strap (16) has attached to is two sets of buckles (18), (20), (22), (24). The watch (12) also has attached to it a longer elastic strap (14) having slidably attached to it a strap retaining band (26). When it is desired to configured the watchband (10) such that it can be worn on the upper arm, the longer strap (16) is passsed through one set of buckles (22), (24) located at the free end of the shorter strap (16). The free end of the longer strap (14) is then passed through the strap retaining band (26). When it is desired to configured the watchband (10) such that it can be worn on the wrist, the longer strap (14) first passes through a set of buckles (18), (20) located on the shorter strap (16) near the straps attachment to the watch (12) and then through the set of buckles (22), (24) located at the free end of the shorter strap (16) and finally through the strap retaining band (26).

8 Claims, 1 Drawing Sheet

MULTIPLE CONFIGURATION ADJUSTABLE WATCH AND BAND

TECHNICAL FIELD

The invention relates to a convertible watchband which functions both as a conventional watchband, for positioning a watch on the user's wrist and alternatively converts to an unorthodox watchband for positioning a watch on the user's upper arm.

BACKGROUND OF THE INVENTION

Conventional watchbands are designed to position a watch on the user's wrist. Because the wristwatch has become a fashion accessory, the watchband has been designed and redesigned to keep in step with current trends in fashion. Regardless of this constant design and redesign, watchbands have primarily retained their basic form and function. The watchband remains a strap with a watch secured to it which goes around the wrist of the user. This strap may be made of leather, metal or plastic and may be elastic or have either a buckle or clasp. Whatever form the watchband takes, its purpose is to position a wristwatch on the users wrist.

Current fashion trends have produced variations on this. No longer is a single wristwatch worn on the wrist of one arm, it is now fashionable to have multiple wristwatches worn on either the right or left or both wrists. One current trend is to wear multiple wristwatches in line from the base of the wrist and up the bare forearm. Wristwatches can even be found on the ankles of some fashion trend setters. As the above demonstrates, the fashion trends of the wearing of wristwatches no longer are limited to a single watch on a single wrist, the current direction of the fashion is away from the ordinary and towards the unconventional.

DISCLOSURE OF THE INVENTION

The invention as claimed is intended to provide a watch capable of accommodating fashion advancement in the use of wristwatches. It solves the problem of how to provide a watchband which can be used as conventional watchbands, to position the watch on the users wrist and alternatively convert to an unorthodox watchband for positioning a watch on the user's upper arm.

To achieve this, the present invention utilizes a unique watchband configuration which incorporates two sets of buckles and a two piece elastic strap. When the watch is worn around the wrist, the watchband is configured through the two sets of buckles such that the diameter encircled by the watchband is substantially that of the user's wrist. When the watch is worn non-conventionally around the user's upper arm, the watchband is configured such that the diameter it encircles is substantially that of the relatively larger diameter of the user's upper arm. The configuration of the strap and the position of the buckles will become more apparent from the description of the drawings.

DETAILED DESCRIPTION OF THE DRAWINGS

Figure 1:
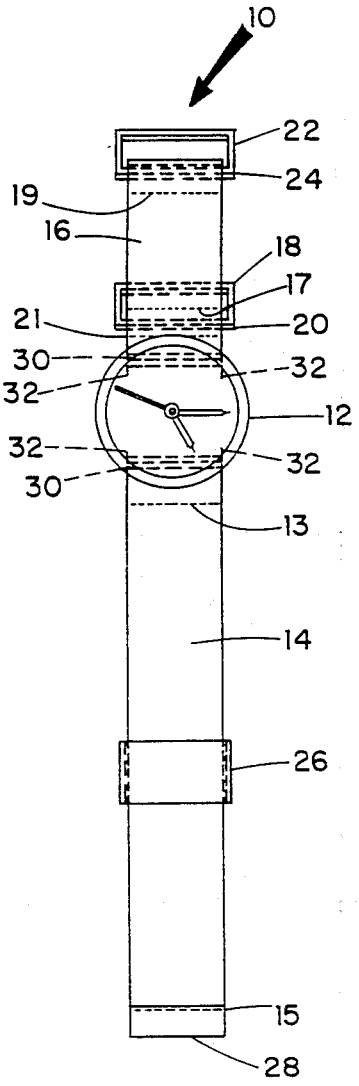
FIG. 1 is a top plan view of the inventive device.

FIG. 1. The inventive watchband 10 is comprised of a longer elastic strap 14 attached along the periphery of the watch 12 by passing the end of the longer elastic strap 14 though a gap created between post 30, secured to arms 32, and watch 12 sewing this end of the longer strap 14 to a point on the longer strap 14. A shorter elastic strap 16 is similarly attached. The shorter strap has two sets of buckles 18, 20 and 22, 24. These buckles 18, 20 and 22, 24 are secured to the strap 16 by the end of the strap passing through them and sewed to the under side of the strap 16 as indicated by seams 17 and 19. The strap 16 is secured to the watch 12 in a similar fashion by forming a loop and sewing the strap to itself as indicated by seam 21. The longer elastic strap 14 is also attached to the watch 12 by a similar loop formed by sewing the end of the strap to the strap as indicated by seam 13. The longer elastic strap 14 is terminated by a durable strap terminator 28 sewn to it by seam 15 and has slidably attached to it a strap retaining band 26.

Figure 2:
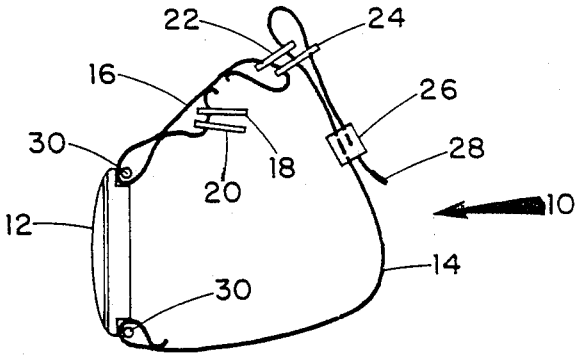
FIG. 2 is a side view of the inventive device as configured to be worn on the user's upper arm.

FIG. 2 is a view of the inventive device as used when positioning the watch on the user's upper arm. The longer elastic strap 14 passes through the buckles 22 and 24 at the end of the shorter elastic strap 16. The end of the longer elastic strap 14 then passes through the strap retaining band 26. A large circumference of the band is obtained to allow the inventive device to be positioned on the user's upper arm.

Figure 3:
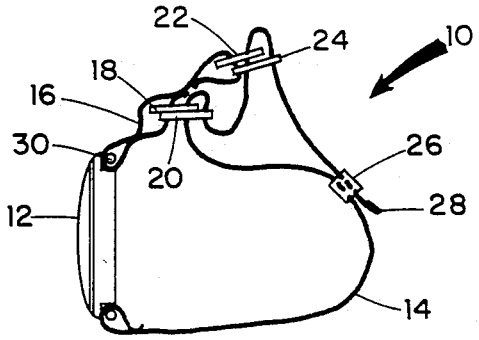
FIG. 3 is a side view of the inventive device as configured to be worn on the user's wrist.

FIG. 3 is a view of the inventive device as used when positioning the watch on the user's wrist. The longer elastic strap 16 passes first through the buckles 18 and 20 located on the shorter elastic strap 16 close to the watch 12 and then passes through the buckles 22 and 24 located at the end of the shorter elastic strap 16, the durable strap terminator 28 end of the longer elastic strap 14 finally passes through the strap retaining band 26. Thus a smaller circumference of the band is obtained for securing the inventive device to the user's wrist.

I claim:

1. An improved watch, comprising;

(a) a watch;

(b) a first strap, having first and second ends, secured to said watch at said first end of said first strap;

(c) a strap end retaining means, securing said second end of said first strap to a user selectable point positioned between said first and said second ends of said first strap to vary the effective length of said first strap and form a loop at the end of said first strap;

(d) a second strap having first and second ends, said second strap being secured to said watch at said second end of said second strap;

(e) first buckle means secured to said second strap at said first end of said second strap and adapted to couple to said loop and to allow said second end of said first strap to pass through said first buckle means; and (f) second buckle means secured to said second strap between said first and second ends of said second strap and adapted to couple to said loop.

2. An improved watch as in claim 1, wherein said second end of said first strap and said second end of said second strap are secured to said watch by a first securing means associated with said first strap and a second securing means associated with said second strap, said first and second securing means, comprising a pair of arms extending from said watch; and a post positioned between said arms such that there is a gap between said post and said watch; and further compromising first and second attachment means for attaching said second end of said first strap and said second end of said second strap to a respective one of said securing means.

3. An improved watch as in claim 2, wherein said first attachment means for attaching said second end of said first strap to said securing means associated with said second end of said first strap comprises a portion of said first strap passing through said gap between said post and said watch of said securing means associated with said second end of said first strap and securing said second end of said first strap to a point on said first strap; and said second attachment means for attaching said second end of said second strap to said securing means associated with said second end of said second strap comprises a portion of said second strap passing through said gap between said post and said watch of said securing means associated with said second end of said second strap and securing said second end of said second strap to a point on said second strap.

4. An improved watch as in claim 1, wherein said first strap and said second strap are elastic.

5. An improved watch as in claim 1, wherein securing of said second end of said first strap and said second end of said second strap to said attachment means is achieved by sewing thread passing said second end of said first strap to said first strap and sewing thread passing said second end of said second strap to said second strap.

6. An improved watch as in claim 1, wherein said first buckle means is secured to said first end of said second strap by passing said first end of said second strap through said first buckle means and sewing said first end of said second strap to said second strap.

7. An improved watch as in claim 6, wherein said second buckle means is secured to said second strap by passing said second end of said second strap through said second buckle means and sewing said second end of said second strap to a point on said second strap.

8. An improved watch as in claim 1, wherein said first and second buckle means each comprises a pair of closed rings.

* * * * *